US006616202B2

(12) United States Patent
Choi

(10) Patent No.: US 6,616,202 B2
(45) Date of Patent: Sep. 9, 2003

(54) INNER HANDLE ASSEMBLY OF A SLIDING DOOR

(75) Inventor: Jae-hong Choi, Namyangju-shi (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 09/782,363

(22) Filed: Feb. 13, 2001

(65) Prior Publication Data

US 2002/0163209 A1 Nov. 7, 2002

(30) Foreign Application Priority Data

Nov. 14, 2000 (KR) ..... 2000-67374

(51) Int. Cl.[7] ..... E05B 3/00

(52) U.S. Cl. ..... 292/336.3; 292/DIG. 31; 292/DIG. 46

(58) Field of Search ..... 292/336.3, 347, 292/DIG. 12, DIG. 31, DIG. 46, DIG. 63; 16/412

(56) References Cited

U.S. PATENT DOCUMENTS 4,993,763 A * 2/1991 Tanimoto et al. ..... 292/336.3
5,141,266 A * 8/1992 Braun et al. ..... 292/216
5,183,302 A * 2/1993 Pelachyk et al. ..... 292/336.3
5,221,115 A * 6/1993 Takimoto ..... 292/216
5,234,237 A * 8/1993 Gergoe et al. ..... 292/201
5,458,381 A * 10/1995 Dziuk et al. ..... 292/336.3
5,573,287 A * 11/1996 Takimoto ..... 292/106
5,605,363 A 2/1997 Kapes
5,794,994 A * 8/1998 Miyagawa et al. ..... 292/336.3
5,979,949 A * 11/1999 Finkelstein et al. ..... 292/113
6,036,244 A * 3/2000 Tyves et al. ..... 292/336.3

* cited by examiner

*Primary Examiner*—J. J. Swann
*Assistant Examiner*—Thomas Ho
(74) *Attorney, Agent, or Firm*—Davis & Bujold, P.L.L.C.

(57) ABSTRACT

Disclosed is an inner handle assembly mounted on a sliding door of a car. An inner handle is fixed at a housing to rotate in both directions and always returned to a neutral position by an inner handle operation controlling mechanism. Therefore, if the inner handle is turned in the door opening direction or if the door closing direction from the neutral position, a door-open maintaining mechanism or a door-close maintaining mechanism is released. Therefore, only by applying power in any one direction of the inner handle, the sliding door can be easily opened or shut.

5 Claims, 3 Drawing Sheets

INNER HANDLE ASSEMBLY OF A SLIDING DOOR

BACKGROUND OF THE INVENTION

1. Field of the Invention

The present invention relates to an inner handle assembly mounted to a sliding door, and more particularly, to an inner handle assembly of a sliding door having a door-open maintaining means for maintaining an opened state of the sliding door, which can allow an inner handle to be operated conveniently to open and shut the sliding door.

2. Description of the Related Art

A sliding door mounted on a van type car is in a sliding type that it slides in the back and forth direction of a car body along the side surface of the car body to be opened or shut. Therefore, passengers can get in or off the car easily and the opening and shutting of the door is not interfered from the surroundings even in a small area.

Identically with a general hinged door, the conventional sliding door includes a door-close maintaining means for maintaining a closed state of the door, a locking controller connected to the door-close maintaining means to control the operation of the door-close maintaining means, inner handle assembly and outer handle assembly connected to the locking controller to release the door from the closed state, and a door locking knob connected to the locking controller for controlling the locking controller to lock the door in the closed state. If the door opened is closed, the door is automatically fastened by the door-close maintaining means not to be opened. When inner and outer handles are operated in the state that the door is closed, the door-close maintaining means is released to open the closed door. When the door locking knob is operated, the door is not opened even though the inner and outer handles are operated in the state that the door is closed.

However, in the conventional sliding door, if the door is opened in the state that the car is parked on a slanted road surface, the door is automatically closed by self-weight, thereby the passenger may be injured by the automatically closed door. To prevent the problem, the passengers must hold the opened door.

To solve the problem, a method for installing a door-open maintaining means inside the sliding door to maintain the open state of the door has been disclosed and widely used. Moreover, the locking controller, the inner handle and the outer handle have been under study in many directions to control the operation of the door-open maintaining means.

For an example, a sliding door control assembly is disclosed in U.S. Pat. No. 5,605,363 assigned to Chrysler Corporation. In such sliding door control assembly, if the outer handle is pulled, the door-open maintaining means and the door-close maintaining means are simultaneously released. If the passenger grasps the inner handle and presses a button mounted on the inner handle, the door-open maintaining means and the door-close maintaining means are simultaneously released.

In case of the outer handle, as the passenger, who stands outside, operates the outer handle, the operation of the handle is natural. However, in case of the inner handle, as the passenger must slide the door to open or shut in a small area of the inside of the car while grasping the inner handle with one hand and pressing the button, thereby it is very difficult and complicate in releasing the sliding door.

For another example, a method that the door-open maintaining means and the door-close maintaining means are released simultaneously when the inner handle is pulled in the same way as the outer handle has been also disclosed and used. However, the method is more complicate in releasing the sliding door than the sliding door control assembly disclosed in U.S. Pat. No. 5,605,363.

SUMMARY OF THE INVENTION

It is, therefore, an object of the present invention to provide an inner handle assembly of a sliding door, which allows an inner handle to be operated conveniently to open and shut the sliding door.

To achieve the above object, the present invention provides an inner handle assembly of a sliding door comprising: a housing having a plurality of coupling parts and/or projections, the housing being assembled inside the sliding door through the medium of a coupling member such as a screw; an inner handle hinged to the housing to rotate in both directions; and an inner handle operation controlling means for controlling the operation of the inner handle to be always returned to a neutral position.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
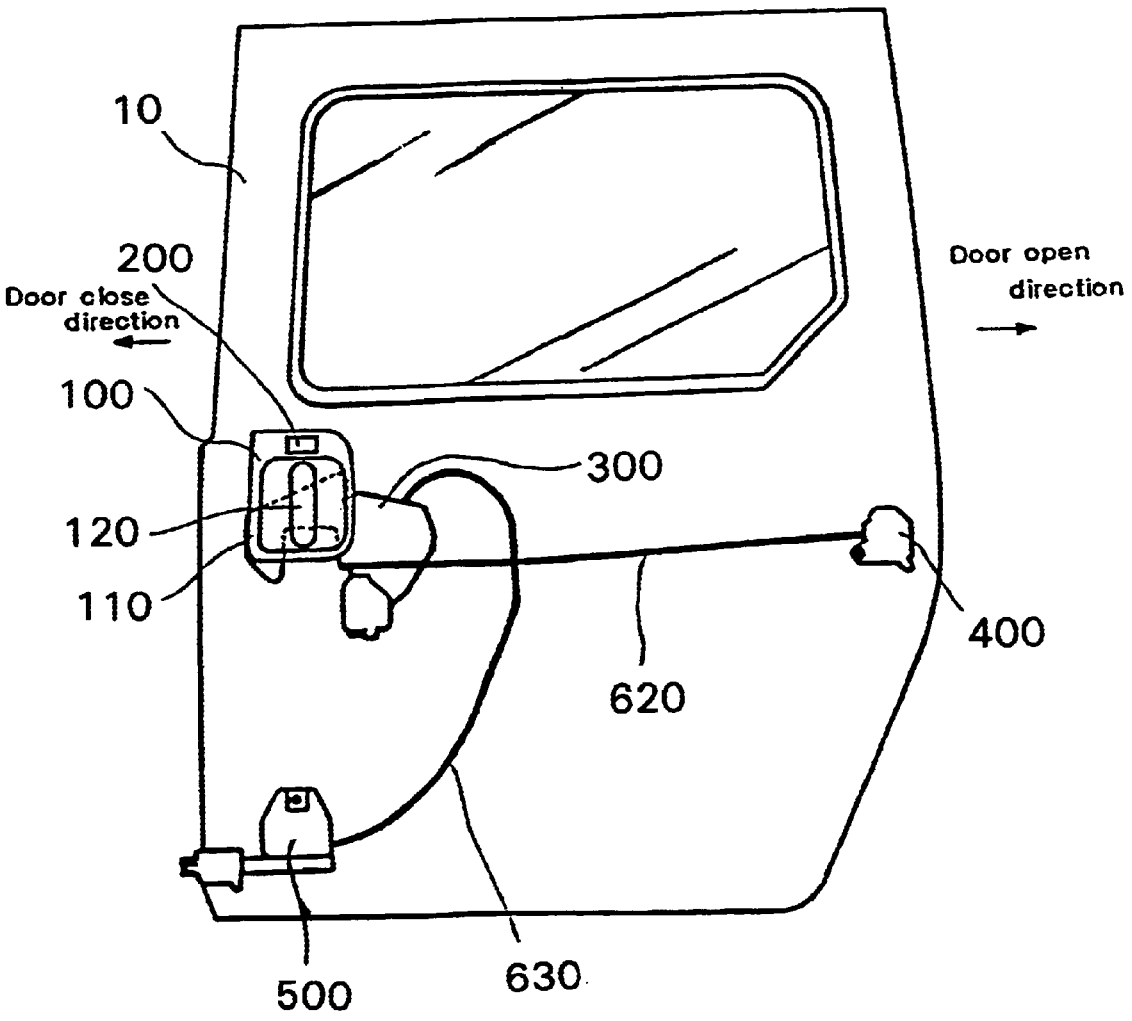
FIG. 1 is a schematic view of a sliding door opening and shutting device having an inner handle assembly according to the present invention.

The present invention will now be described in detail in connection with preferred embodiments with reference to the accompanying drawings. For reference, like reference characters designate corresponding parts throughout several views.

FIG. 1 is a schematic view of a construction of a sliding door opening and shutting device having an inner handle assembly according to the present invention. In FIG. 1, the sliding door opening and shutting device includes a door-close maintaining means 400 for maintaining a closed state of a sliding door 10, a door-open maintaining means 500 for maintaining an opened state of the sliding door 10, a locking controller 300 connected to the door-close maintaining means 400 and the door-open maintaining means 500 to control the operation of the door-close maintaining means 400 and the door-open maintaining means 500, inner handle assembly 100 and outer handle assembly operating the locking controller 300 to selectively release the sliding door 10 from the closed state, and a door locking knob 200 connected to the locking controller 300 to control the operation of the locking controller 300.

The connected operation of the components of the sliding door opening and shutting device will be described briefly. If an inner handle 120 and an outer handle which are respectively provided to the inner handle assembly 100 and the outer handle assembly, are manipulated, the locking controller 300 connected to the handles is operated, and thereby the door-close maintaining means 400 and the door-open maintaining means 500 are selectively released by the locking controller 300. If the door locking knob 200 is operated, the operation of the locking controller 300 connected to the door locking knob 200 is controlled, and thereby the operation of the locking controller 300 by the inner handle 120 and the outer handle is selectively stopped.

Figure 2A:
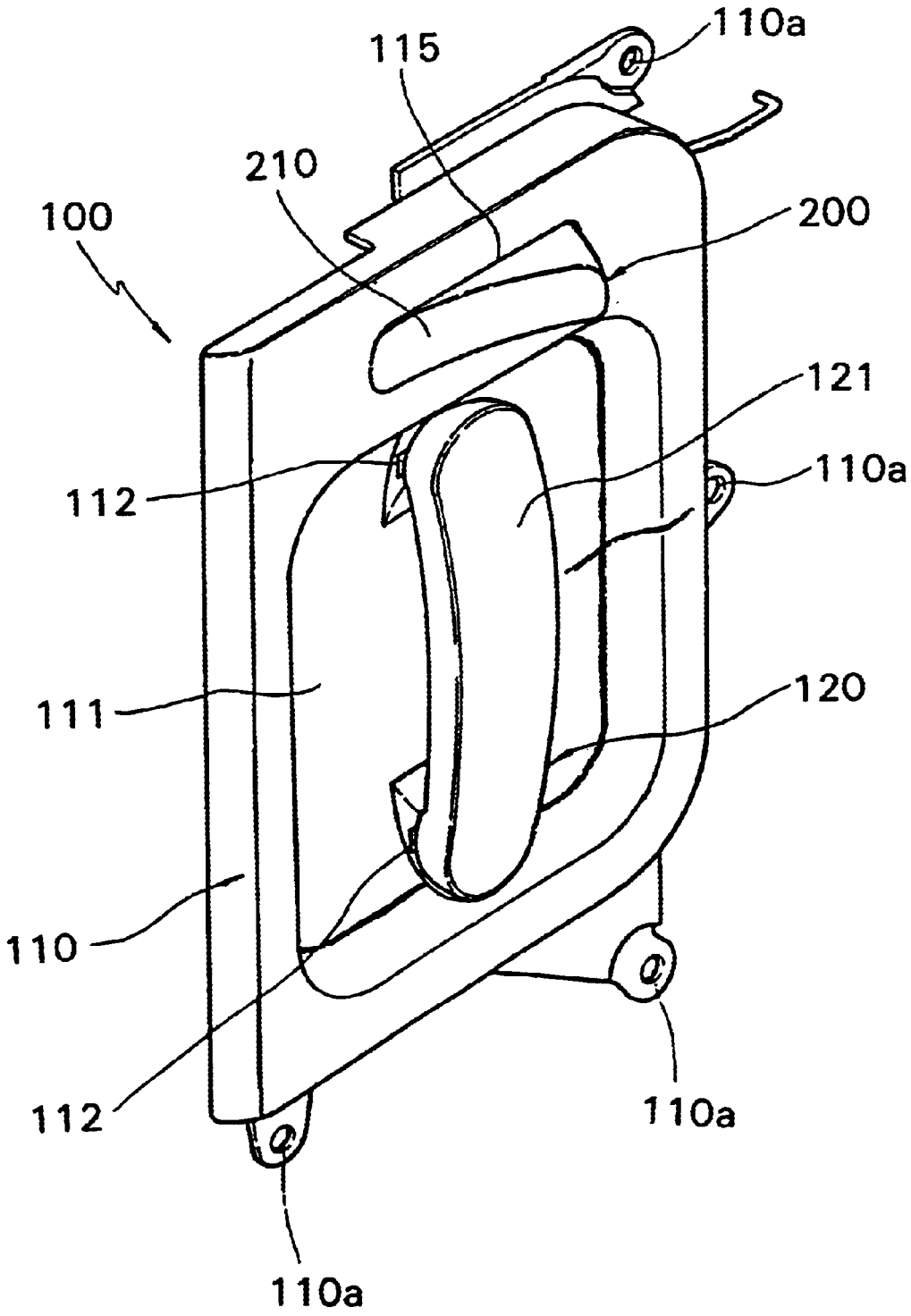
FIGS. 2*a* and 2*b* are perspective views, seen from different directions from each other, of an example of the inner handle assembly according to the present invention.
Figure 2B:
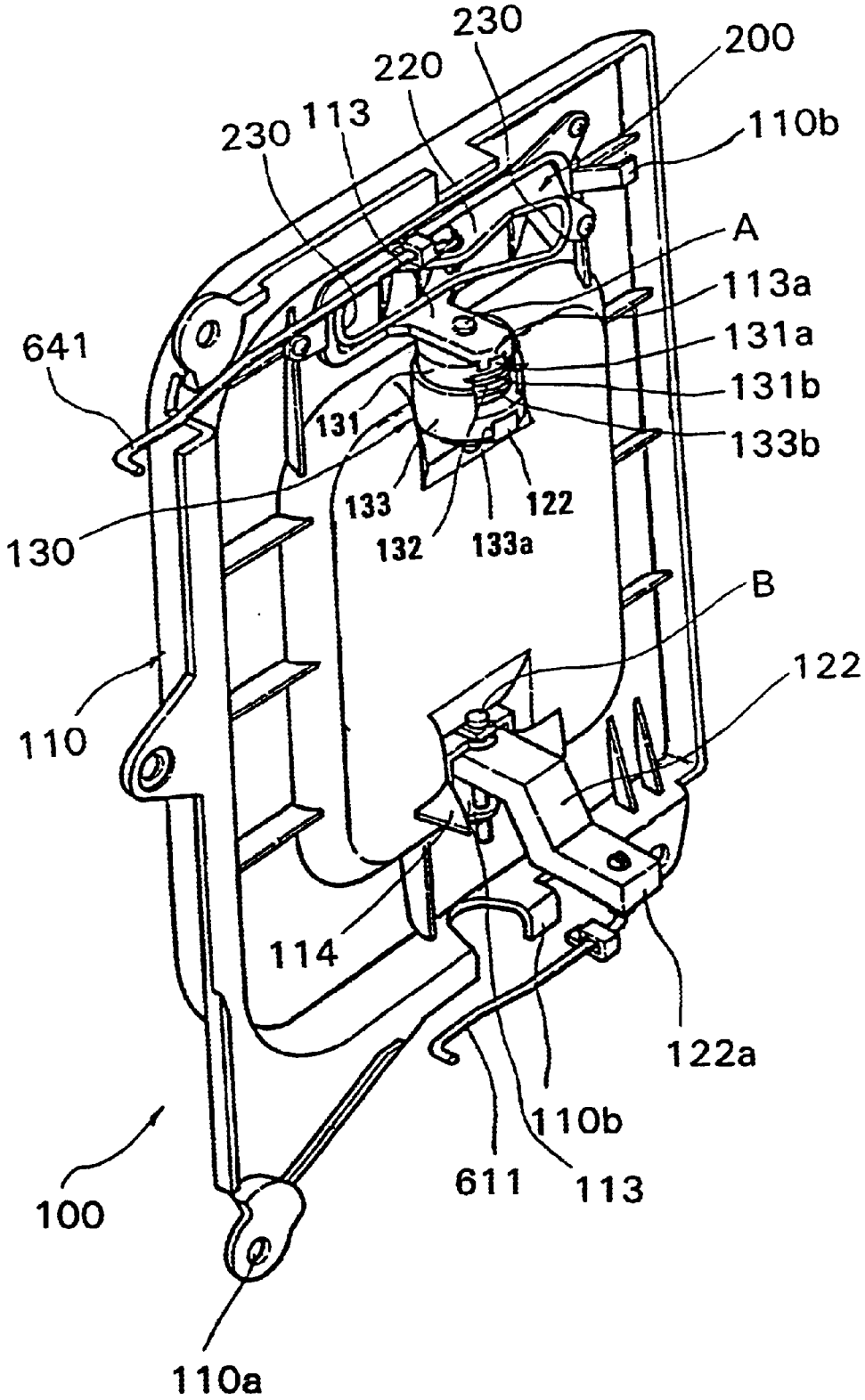

FIGS. 2*a* and 2*b* are perspective views, seen from different directions from each other, of the inner handle assembly of FIG. 1. In FIGS. 2*a* and 2*b*, the inner handle assembly includes: a housing 110 having a plurality of coupling parts 110*a* and projections 110*b*, the housing 110 being assembled inside the sliding door 10 through the medium of a coupling member such as a screw; the inner handle 120 hinged to the housing 110 to rotate in both directions; and an inner handle operation controlling means 130 for controlling the operation of the inner handle 120 to be always returned to a neutral position. The housing 110 includes an inner handle seating space 111 formed in an exposed surface of the housing 110, a pair of insertion holes 112 for inserting both ends of the inner handle 120 through the insertion holes 112, a pair of hinge connecting parts 113 formed oppositely at the upper and lower portions of the rear surface of the housing 110 to fix the ends of the inner handle 120, a stopper 114 formed at both sides of the lower insertion hole 112 to control an angle of rotation of the inner handle 120, and a fixing part 113*a* of a convexo-concave form formed at the bottom of the hinge connecting part 113 arranged higher than the upper insertion hole 112. The housing further includes a knob insertion hole 115 formed at a portion located higher than the inner handle seating space 111 to insert the door locking knob 200 through the knob insertion hole 115, and thereby the door locking knob 200 is rotatably mounted on a hinge shaft (not shown). The hinge shaft is located at the center of the door locking knob 200 to make the door locking knob 200 rotate in right and left directions on the hinge shaft. The door locking knob 200 includes an operation part 210 formed on an exposed surface of the door locking knob 200, a rod connecting part 220 formed at the rear surface to connect a rod 641, and a stopper 230 for controlling an angle of rotation of the door locking knob 200.

The inner handle 120 is generally in the form of a "[" mark, and both ends 122 of the inner handle 120 are inserted into the insertion holes 112 of the housing 110, projected to the rear surface of the housing 110 and fixed to rotate on hinge shafts (A and B), such that a grip part 121 of the center of the inner handle 120 is arranged in the inner handle seating space 111 of the housing 110. The inner handle 120 has a rod connecting part 122*a* formed at the lower end 122 of the inner handle 120 to connect a rod 611.

The inner handle operation controlling means 130 includes: a rotational member 133 rotated with the ends 122 of the inner handle 120, the rotational member 133 having a groove 133*b* formed at the external surface, through which an end of a spring is projected, and a hole 133*a* formed at the bottom of the inner handle operation controlling means 130 to insert and engage the upper end 122 of the inner handle 120; a spring fixing member 131 fit to an upper open portion of the rotational member 133 and engaged and fixed to the fixing part 113*a* of the housing 110, the spring fixing member 131 having a fixed part 131*a* of a convexo-concave form, which is formed at the upper surface and engages the fixing part 113*a* of the housing 110, and a groove 131*b* formed at the external surface of the spring fixing member 131, through which the other end of the spring is projected; and a torsion spring 132 seated in the spring fixing member 131, the torsion spring having both ends projected through the groove 133*b* of the rotational member 133 and the groove 131*b* of the spring fixing member 131 respectively and resiliently supported at both sides of the grooves 131*b* and 133*b*. The inner handle operation controlling means 130 is inserted between the upper end 122 of the inner handle 120 and the hinge connecting part 113 having the fixing part 113*a* and fixed through the medium of the hinge shaft (A).

In FIGS. 2*a* and 2*b*, the operation part 210 of the door locking knob 200 is pressed in the left direction, the door locking knob 200 is off, and the inner handle 120 is located in the neutral position by the restoring force of the torsion spring 132. Under this condition, supposing that the sliding door 10 is closed, the operation of the sliding door opening and shutting device will be described. In the state that the sliding door 10 is closed, if the passenger pulls or pushes the inner handle 120 in the door opening direction, the inner handle 120 is rotated in the door opening direction on the hinge shafts (A and B), and thereby the rod 611 connected to the rod connecting part 122*a* of the inner handle 120 is pulled. After that, the locking controller 300 connected to the rod 611 is operated corresponding to the operation of the rod 611 to release the door-close maintaining means 400 from the gripped state, and thereby the sliding door 10 is opened. After that, when the sliding door 10 is continuously opened and reaches a prescribed position, the door-open maintaining means 500 engages the structure of a car, and thereby the sliding door 10 maintains the opened state by the door-open maintaining means 500.

In this condition, if the passenger pulls or pushes the inner handle 120 in the door closing direction, the inner handle 120 is rotated in the door closing direction on the hinge shafts (A and B), and thereby the rod 611 connected to the rod connecting part 122*a* of the inner handle 120 is pulled. After that, the locking controller 300 connected to the rod 611 is operated corresponding to the operation of the rod 611 to release the door-open maintaining means 500 from the gripped state, and thereby the sliding door 10 is closed.

After that, when the sliding door 10 is continuously closed and reaches a prescribed position, the door-close maintaining means 400 engages the structure of a car, and thereby the sliding door 10 maintains the closed state by the door-close maintaining means 400.

Meanwhile, if the inner handle 120 is turned in any one direction, in the state that one end of the torsion spring 132 is fixed on one side of the groove 131*b* of the spring fixing member 131, the other end of the torsion spring 132 is pressed by the other end of the groove 133*b* of the rotational member 133, which is rotated. At this time, if the passenger put the inner handle 120 off, the inner handle 120 is returned to the neutral position by the restoring force of the torsion spring 132.

In the state of FIGS. 2*a* and 2*b*, if the passenger presses the operation part 210 of the door locking knob 200 to the left direction and turns on the door locking knob 200, the door locking knob 200 is rotated in the door opening direction, and thereby the rod 641 connected to the rod connecting part 220 is pulled. After that, the locking controller 300 connected to the rod 641 is operated corresponding to the operation of the rod 641, and thereby the sliding door 10 is not opened even though the inner handle 120 is turned in the door opening direction.

According to the present invention, if the inner handle 120 is pushed or pulled in the door opening direction in the state that the sliding door 10 is closed, the inner handle 120 is turned in the door opening direction from the neutral position, and thereby the door-close maintaining means 400 is released by the locking controller 300. If the inner handle 120 is pulled or pushed in the door closing direction in the state that the sliding door 10 is opened, the inner handle 120 is turned in the door closing direction from the neutral position, and thereby the door-open maintaining means 500 is released by the locking controller 300. Therefore, the opening and shutting of the sliding door 10 can be performed sufficiently only by turning the inner handle 120 in one direction, i.e., in the door opening direction or in the door closing direction.

As previously described, according to the present invention, the inner handle is fixed at the housing to rotate in both directions and always returned to the neutral position by the inner handle operation controlling means. Therefore, if the inner handle is turned in the door opening direction or in the door closing direction from the neutral position, the door-open maintaining means or the door-close maintaining means is released. Therefore, only by applying power in any one direction of the inner handle, the sliding door can be easily opened or shut, thereby providing the passenger with the convenience.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An inner handle assembly for operating a sliding door of a vehicle, the inner handle assembly comprising:

a housing demountably attached to an inner side of the sliding door; the housing having an inner handle seating space and a separate locking knob insertion hole spaced from and located vertically above the inner handle seating space on the housing;

a door locking knob having a locked position and an unlocked position rotatably defined by an angle of rotation of the locking knob about a hinge shaft located within the knob insertion hole;

a stopper for controlling the angle of rotation of the door locking knob;

the door locking knob having an operation portion formed on an exposed surface of the door locking knob and a rod connecting portion formed on a rear surface of the locking knob to attach a locking mechanism rod;

an inner handle positioned within the inner handle seating space and hingedly connected to the housing to rotate in an opening and a closing direction about a handle neutral position;

an inner handle operation part for controlling the operation of the inner handle to be always returned to a neutral position, the inner handle operation part further comprising;

a rotational member having a sidewall and a first opening formed through the sidewall, the rotational member being connected to and rotated by an upper end of the inner handle;

a fixed member at least partially seated within the sidewall of the rotational member and connected to and held stationary relative to the housing, the fixed member having a second opening communicating with the first opening in the rotational member sidewall;

a torsion spring seated in and radially positioned relative to the fixed and rotational members, the torsion spring having a first and a second ends extending through the second opening of the fixed member and through the first opening of the rotational member to provide relative biased rotation between the rotational member and the fixed member when the inner handle is rotated in any direction.

2. The inner handle assembly as set forth in claim 1, wherein the inner handle operation part is inserted in the assembly via an upper hinge shaft extending between the upper end of the inner handle and a hinge connecting part affixed to the housing.

3. An inner handle assembly of a sliding door comprising:

a housing having a plurality of coupling parts, the housing being assembled inside the sliding door by a coupling member such as a screw;

an inner handle hinged to the housing to rotate in a first and second directions about a vertical axis; and an inner handle operation controlling means for controlling the operation of the inner handle to be always returned to a neutral position, the inner handle operation controlling means having;

a rotational member being connected to and rotated with an upper end of the inner handle, the rotational member having a sidewall with a first opening formed therethrough;

a spring fixing member cooperatively nested within an upper open portion defined by the sidewall of the rotational member, the spring fixing member being fixedly engaged to the housing and having a second opening communicating with the first opening;

a torsion spring having a first and second ends is seated in the spring fixing member, the first and a second ends of the torsion spring extending through the second opening of the spring fixing member and through the first opening of the rotational member to provide relative biased rotation between the rotational member and the fixed member when the inner handle is rotated in any direction; and wherein the inner handle operation controlling means is inserted between the upper end of the inner handle and a fixed hinge connecting part of the housing defining the vertical hinge axis, and the rotational member and the spring fixing member are relatively rotatably biased with respect to one another about the vertical hinge axis.

4. The inner handle assembly as set forth in claim 3, further comprising a door locking knob having a locked position and an unlocked position rotatably defined by an angle of rotation of the locking knob about a hinge shaft located within a knob insertion hole formed in the housing; and the door locking knob having an operation portion formed on an exposed surface of the door locking knob and a rod connecting portion formed on a rear surface of the locking knob to attach a locking mechanism rod.

5. An inner handle assembly for operating a latching mechanism and opening and closing a sliding door of a vehicle, the inner handle assembly comprising:

a housing demountably attached to an inner side of the sliding door; the housing having an inner handle seating space and a separate locking knob insertion hole spaced from and located vertically above the inner handle seating space on the housing;

a door locking knob having a locked position and an unlocked position rotatably defined by an angle of rotation of the locking knob about a hinge shaft located within the knob insertion hole;

a stopper for controlling the angle of rotation of the door locking knob;

the door locking knob having an operation portion formed on an exposed surface of the door locking knob and a rod connecting portion formed on a rear surface of the locking knob to attach a locking mechanism rod;

an inner handle positioned within the inner handle seating space and hingedly connected to the housing to actuate the latching mechanism in both a clockwise and counter-clockwise direction about a handle neutral position and;

an inner handle operation part for controlling the operation of the inner handle to be always returned to a neutral position, the inner handle further comprising;

a spring fixing member fixed to the housing and supporting a torsion spring cooperatively radially nested within a rotational member connected to and rotated with the inner handle; and wherein the torsion spring has a first and second ends extending through a first and second communicating openings formed in the spring fixing member and rotational member respectively to provide relative biased rotation between the rotational member and the spring fixing member when the inner handle is rotated in any direction.

* * * * *